US009765447B2

(12) United States Patent
Tam et al.

(10) Patent No.: US 9,765,447 B2
(45) Date of Patent: Sep. 19, 2017

(54) PROCESS OF MAKING HIGH TENACITY, HIGH MODULUS UHMWPE FIBER

(71) Applicant: HONEYWELL INTERNATIONAL INC., Morris Plains, NJ (US)

(72) Inventors: Thomas Tam, Chesterfield, VA (US); John Armstrong Young, Midlothian, VA (US); Ralf Klein, Midlothian, VA (US); Mark Tallent, Midlothian, VA (US); Henry Gerard Ardiff, Chesterfield, VA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 14/922,339

(22) Filed: Oct. 26, 2015

(65) Prior Publication Data

US 2016/0130730 A1 May 12, 2016

Related U.S. Application Data

(62) Division of application No. 13/766,112, filed on Feb. 13, 2013, now Pat. No. 9,169,581.

(60) Provisional application No. 61/602,963, filed on Feb. 24, 2012.

(51) Int. Cl.

| | |
|---|---|
| ***D01D 5/04*** | (2006.01) |
| ***D01D 5/06*** | (2006.01) |
| ***D01D 5/12*** | (2006.01) |
| ***D01D 5/16*** | (2006.01) |
| ***D01F 1/02*** | (2006.01) |
| ***D01F 1/10*** | (2006.01) |
| ***D02J 1/22*** | (2006.01) |
| ***D01F 6/04*** | (2006.01) |
| ***D02G 3/02*** | (2006.01) |
| ***D04H 13/00*** | (2006.01) |
| ***D04H 1/593*** | (2012.01) |
| ***D04H 1/70*** | (2012.01) |
| ***D01D 5/088*** | (2006.01) |
| ***D01D 11/00*** | (2006.01) |

(52) U.S. Cl.

CPC ..... *D01F 6/04* (2013.01); *D01D 5/088* (2013.01); *D01D 11/00* (2013.01); *D02G 3/02* (2013.01); *D02J 1/222* (2013.01); *D02J 1/223* (2013.01); *D02J 1/228* (2013.01); *D04H 1/593* (2013.01); *D04H 1/70* (2013.01); *D04H 13/00* (2013.01); *D10B 2321/0211* (2013.01); *Y10T 428/298* (2015.01); *Y10T 442/2008* (2015.04)

(58) Field of Classification Search

CPC .. D01D 5/04; D01D 5/06; D01D 5/12; D01D 5/16; D01F 1/02; D01F 1/10; D01F 6/04; D02G 3/02; D02J 1/22; D02J 1/222; D02J 1/223; D02J 1/228

USPC ..... 264/85, 103, 178 F, 183, 184, 203, 205, 264/210.6, 210.7, 210.8, 211.14, 211.16

See application file for complete search history.

(56) References Cited

U.S. PATENT DOCUMENTS

| | | | | |
|---|---|---|---|---|
| 4,403,012 | A | 9/1983 | Harpell et al. | |
| 4,413,110 | A | 11/1983 | Kavesh et al. | |
| 4,457,985 | A | 7/1984 | Harpell et al. | |
| 4,536,536 | A | 8/1985 | Kavesh et al. | |
| 4,551,296 | A | 11/1985 | Kavesh et al. | |
| 4,617,233 | A | 10/1986 | Ohta et al. | |
| 4,623,574 | A | 11/1986 | Harpell et al. | |
| 4,650,710 | A | 3/1987 | Harpell et al. | |
| 4,663,101 | A | 5/1987 | Kavesh et al. | |
| 4,737,402 | A | 4/1988 | Harpell et al. | |
| 4,748,064 | A | 5/1988 | Harpell et al. | |
| 4,916,000 | A | 4/1990 | Li et al. | |
| 5,032,338 | A | 7/1991 | Weedon et al. | |
| 5,443,904 | A | 8/1995 | Ohta et al. | |
| 5,547,626 | A * | 8/1996 | Ohta | D01F 6/04 264/203 |
| 5,552,208 | A | 9/1996 | Lin et al. | |
| 5,578,374 | A | 11/1996 | Dunbar et al. | |
| 5,587,230 | A | 12/1996 | Lin et al. | |
| 5,736,244 | A | 4/1998 | Kavesh et al. | |
| 5,741,451 | A | 4/1998 | Dunbar et al. | |
| 5,958,582 | A | 9/1999 | Dunbar et al. | |
| 5,972,498 | A | 10/1999 | Kavesh et al. | |
| 6,448,359 | B1 | 9/2002 | Kavesh | |
| 6,642,159 | B1 | 11/2003 | Bhatnagar et al. | |
| 6,746,975 | B2 | 6/2004 | Kavesh | |
| 6,841,492 | B2 | 1/2005 | Bhatnagar et al. | |

(Continued)

FOREIGN PATENT DOCUMENTS

| | | |
|---|---|---|
| EP | 1746187 | 1/2007 |
| JP | 2006045755 | 2/2006 |
| JP | 2010525184 | 7/2010 |
| WO | 2008141405 | 11/2008 |

OTHER PUBLICATIONS

Jeffery D. Peterson, et al., "Kinetics of the Thermal and Thermo-Oxidative Degradation of Polysterene, Polyethylene and Poly(Propylene);" Macromolecular Chemistry and Physics; vol. 202; No. 6; pp. 775-784 (2001).

Kurtz, "The UHMWPE Handbook," Academic Press, pp. 269-270 (Apr. 2004).

Vlasblom, "Handbook of Tensile Properties of Textile and Technical Fibres," Woodhead Publishing, pp. iii, iv, 437-441 (Oct. 2009).

*Primary Examiner* — Leo B Tentoni

(74) *Attorney, Agent, or Firm* — Roberts & Roberts, LLP; Richard S. Roberts, Jr.

(57) ABSTRACT

Processes for preparing ultra-high molecular weight polyethylene ("UHMW PE") filaments and multi-filament yarns, and the yarns and articles produced therefrom. Each process produces UHMW PE yarns having tenacities of 45 g/denier to 60 g/denier or more at commercially viable throughput rates.

18 Claims, No Drawings

(56) References Cited

U.S. PATENT DOCUMENTS

| | | | |
|---|---|---|---|
| 6,846,758 | B2 | 1/2005 | Bhatnagar et al. |
| 6,969,553 | B1 | 11/2005 | Tam et al. |
| 7,078,099 | B1 | 7/2006 | Tam et al. |
| 7,115,318 | B2 | 10/2006 | Tam et al. |
| 7,147,807 | B2 | 12/2006 | Kavesh |
| 7,344,668 | B2 | 3/2008 | Tam et al. |
| 7,370,395 | B2 | 5/2008 | Tam |
| 7,638,191 | B2 | 12/2009 | Tam et al. |
| RE41,268 | E | 4/2010 | Kavesh |
| 7,736,561 | B2 | 6/2010 | Tam et al. |
| 2005/0093200 | A1 | 5/2005 | Tam et al. |
| 2007/0231572 | A1 | 10/2007 | Tam et al. |
| 2008/0305331 | A1 | 12/2008 | Tam et al. |
| 2009/0117805 | A1 | 5/2009 | Simmelink et al. |
| 2010/0078851 | A1 | 4/2010 | Tam et al. |
| 2011/0039058 | A1 | 2/2011 | Tam et al. |
| 2011/0266710 | A1 | 11/2011 | Tam et al. |
| 2011/0269359 | A1 | 11/2011 | Tam et al. |
| 2012/0198808 | A1 | 8/2012 | Bosman et al. |
| 2014/0283674 | A1 | 9/2014 | Tam et al. |

* cited by examiner

PROCESS OF MAKING HIGH TENACITY, HIGH MODULUS UHMWPE FIBER

CROSS-REFERENCE TO RELATED APPLICATIONS

This application is a Divisional of U.S. application Ser. No. 13/766,112, filed Feb. 13, 2013, now U.S. Pat. No. 9,169,581, which claims the benefit of U.S. Provisional Application Ser. No. 61/602,963, filed on Feb. 24, 2012, the disclosures of which are incorporated by reference herein in their entireties.

BACKGROUND

Technical Field

This invention relates to processes for preparing ultra-high molecular weight polyethylene ("UHMW PE") filaments and multi-filament yarns, and articles produced therefrom.

Description of the Related Art

Ultra-high molecular weight poly(alpha-olefin) multi-filament yarns have been produced possessing high tensile properties such as tenacity, tensile modulus and energy-to-break. The yarns are useful in applications requiring impact absorption and ballistic resistance such as body armor, helmets, breast plates, helicopter seats, spall shields, composite sports equipment such as kayaks, canoes bicycles and boats; and in fishing line, sails, ropes, sutures and fabrics.

Ultra-high molecular weight poly(alpha-olefins) include polyethylene, polypropylene, poly(butene-1), poly(4-methyl-pentene-1), their copolymers, blends and adducts having a molecular weight of at least about 300,000 g/mol.

Many different techniques are known for the fabrication of high tenacity filaments and fibers formed from these polymers. High tenacity polyethylene fibers may be made by spinning a solution containing ultra-high molecular weight polyethylene. Ultra-high molecular weight polyethylene particles are mixed with a suitable solvent, whereby the particles are swelled with and dissolved by the solvent to form a solution. The solution is then extruded through a spinneret to form solution filaments, followed by cooling the solution filaments to a gel state to form gel filaments, then removing the spinning solvent to form solvent-free filaments. One or more of the solution filaments, the gel filaments and the solvent-free filaments are stretched or drawn to a highly oriented state in one or more stages. In general, such filaments are known as "gel-spun" polyethylene filaments. The gel spinning process is desirable because it discourages the formation of folded chain molecular structures and favors formation of extended chain structures that more efficiently transmit tensile loads. Gel-spun filaments also tend to have melting points higher than the melting point of the polymer from which they were formed. For example, high molecular weight polyethylene having a molecular weight of about 150,000 to about two million generally have melting points in the bulk polymer of 138° C. Highly oriented polyethylene filaments made of these materials have melting points of from about 7° C. to about 13° C. higher. This slight increase in melting point reflects the crystalline perfection and higher crystalline orientation of the filaments as compared to the bulk polymer. Multi-filament gel spun ultra-high molecular weight polyethylene (UHMW PE) yarns are produced, for example, by Honeywell International Inc.

Various methods for forming gel-spun polyethylene filaments have been described, for example, in U.S. Pat. Nos. 4,413,110; 4,536,536; 4,551,296; 4,663,101; 5,032,338; 5,578,374; 5,736,244; 5,741,451; 5,958,582; 5,972,498; 6,448,359; 6,746,975; 6,969,553; 7,078,099; 7,344,668 and U.S. patent application publication 2007/0231572, all of which are incorporated herein by reference to the extent compatible herewith. For example, U.S. Pat. Nos. 4,413,110, 4,663,101 and 5,736,244 describe the formation polyethylene gel precursors and the stretching of low porosity xerogels obtained therefrom to form high tenacity, high modulus fibers. U.S. Pat. Nos. 5,578,374 and 5,741,451 describe post-stretching a polyethylene fiber which has already been oriented by drawing at a particular temperature and draw rate. U.S. Pat. No. 6,746,975 describes high tenacity, high modulus multifilament yarns formed from polyethylene solutions via extrusion through a multi-orifice spinneret into a cross-flow gas stream to form a fluid product. The fluid product is gelled, stretched and formed into a xerogel. The xerogel is then subjected to a dual stage stretch to form the desired multifilament yarns. U.S. Pat. No. 7,078,099 describes drawn, gel-spun multifilament polyethylene yarns having increased perfection of molecular structure. The yarns are produced by an improved manufacturing process and are drawn under specialized conditions to achieve multifilament yarns having a high degree of molecular and crystalline order. U.S. Pat. No. 7,344,668 describes a process for drawing essentially diluent-free gel-spun polyethylene multifilament yarns in a forced convection air oven and the drawn yarns produced thereby. The process conditions of draw ratio, stretch rate, residence time, oven length and feed speed are selected in specific relation to one another so as to achieve enhanced efficiency and productivity.

Despite the teachings of the foregoing documents, there remains a need in the art for a process for preparing high tenacity UHMW PE multi-filament yarns with greater productivity that is suitable for commercial scale manufacturing. The theoretical strength of UHMW PE yarn is around 200 g/denier based on C—C bond calculation. However, fibers of such maximum tenacity are not presently achievable due to processability limitations of the UHMW PE polymer. For example, it is understood that UHMW PE fibers having high tenacities correspond to UHMW PE starting material having high molecular weight. Accordingly, UHMW PE fiber tenacity may theoretically be increased by increasing the molecular weight of the UHMW PE raw material from which they are fabricated. However, increases in polymer molecular weight leads to various processing drawbacks. For example, fibers having high tenacities require slower and more carefully controlled fiber drawing to avoid breaking of the fiber during stretching. Such slower fiber drawing is undesirable, however, because it limits fiber output and the commercial viability of the process. Increases in polymer molecular weight also requires elevated extrusion temperatures and pressures to handle the higher molecular weight material, but these more severe conditions may accelerate polymer degradation and limit the attainable fiber tensile properties.

Due to these limitations, the manufacture of high tenacity UHMW PE yarns, particularly those having a yarn tenacity of 45 g/denier or greater, is a challenging and exceedingly slow undertaking. To be sure, any related art discussing the fabrication of UHMW PE fibers having a tenacity of 45 g/denier or more, such as U.S. Pat. No. 4,617,233, refer to achievements that are not capable of being translated to a realistic, commercially viable scale. No method of the related art is presently known that is capable of manufacturing UHMW PE yarns having a tenacity of 45 g/denier or more at a commercially viable throughput rate. Accordingly, there remains a need in the art for a more efficient process for producing strong UHMW PE yarns at high production capacity. The present invention provides a solution to this problem in the art.

SUMMARY OF THE INVENTION

The invention provides an ultra-high molecular weight polyethylene (UHMW PE) multi-filament yarn having a tenacity of at least 45 g/denier, wherein said yarn is fabricated from an UHMW PE polymer having an intrinsic viscosity of at least about 21 dl/g and a yarn intrinsic viscosity that exceeds 90% relative to the intrinsic viscosity of the UHMW PE polymer; wherein said intrinsic viscosities are measured in decalin at 135° C. according to ASTM D1601-99.

The invention also provides a process for producing an ultra-high molecular weight polyethylene (UHMW PE) multi-filament yarn having a tenacity of at least 45 g/denier, wherein said yarn is fabricated from an UHMW PE polymer having an intrinsic viscosity of at least about 21 dl/g and a yarn intrinsic viscosity that exceeds 90% relative to the intrinsic viscosity of the UHMW PE polymer; wherein said intrinsic viscosities are measured in decalin at 135° C. according to ASTM D1601-99, the process comprising:

a) providing a mixture comprising an UHMW PE polymer and a spinning solvent, said UHMW PE polymer having an intrinsic viscosity of at least about 21 dl/g as measured in decalin at 135° C. according to ASTM D1601-99;

b) forming a solution from said mixture;

c) passing the solution through a spinneret to form a plurality of solution filaments;

d) cooling the solution filaments to a temperature below the gel point of the UHMW PE polymer to thereby form a gel yarn;

e) removing the spinning solvent from the gel yarn to form a dry yarn; and f) stretching at least one of the solution filaments, the gel filaments and the solid filaments in one or more stages to form a yarn product having a tenacity of greater than 45 g/d and wherein said yarn product has an intrinsic viscosity that exceeds 90% relative to the intrinsic viscosity of the UHMW PE polymer; wherein said intrinsic viscosities are measured in decalin at 135° C. according to ASTM D1601-99.

The invention further provides a process for producing an ultra-high molecular weight polyethylene (UHMW PE) multi-filament yarn having a tenacity of at least 45 g/denier, comprising:

a) providing a mixture comprising an UHMW PE polymer and a spinning solvent, said UHMW PE polymer having an intrinsic viscosity of at least about 35 dl/g as measured in decalin at 135° C. according to ASTM D1601-99;

b) forming a solution from said mixture;

c) passing the solution through a spinneret to form a plurality of solution filaments;

d) cooling the solution filaments to a temperature below the gel point of the UHMW PE polymer to thereby form a gel yarn;

e) removing the spinning solvent from the gel yarn to form a dry yarn; and f) stretching at least one of the solution filaments, the gel filaments and the solid filaments in one or more stages to form a yarn product having a tenacity of greater than 45 g/d, and wherein said yarn product has an intrinsic viscosity of at least about 21 dl/g; wherein said intrinsic viscosities are measured in decalin at 135° C. according to ASTM D1601-99.

Still further provided is an ultra-high molecular weight polyethylene (UHMW PE) multi-filament yarn having a tenacity of at least 45 g/denier, wherein said yarn is fabricated from a solution comprising UHMW PE and an extractable solvent, wherein said UHMW PE comprises 6.5% or less by weight of said solution, said yarns having a denier per filament of 1.4 dpf to 2.2 dpf.

The invention also includes articles comprising the inventive yarns.

DETAILED DESCRIPTION

For the purposes of the present invention, a "fiber" is an elongate body the length dimension of which is much greater than the transverse dimensions of width and thickness. The cross-sections of fibers for use in this invention may vary widely, and they may be circular, flat or oblong in cross-section. They also may be of irregular or regular multi-lobal cross-section having one or more regular or irregular lobes projecting from the linear or longitudinal axis of the filament. Thus the term "fiber" includes filaments, ribbons, strips and the like having regular or irregular cross-section. As used herein, the term "yarn" is defined as a single continuous strand consisting of multiple fibers or filaments. A single fiber may be formed from just one filament or from multiple filaments. A fiber formed from just one filament is referred to herein as either a "single-filament" fiber or a "monofilament" fiber, and a fiber formed from a plurality of filaments is referred to herein as a "multifilament" fiber. The definition of multifilament fibers herein also encompasses pseudo-monofilament fibers, which is a term of art describing multifilament fibers that are at least partially fused together and look like monofilament fibers.

In general, fibers having high tensile properties are obtained from polyethylene having high intrinsic viscosity, but at higher intrinsic viscosities, dissolving the polyethylene may require longer residence times, thereby affecting the productivity of the manufacturing process. The processes described herein identify steps for improving the processing of polyethylenes of higher intrinsic viscosities, allowing the fabrication of high tenacity yarns at commercially viable throughput rates.

A "commercially viable" throughput rate is a relative term, because at yarn tensile strengths of 45 g/denier and above, the high molecular weight of the UHMW PE raw material requires great care to prevent fiber breakage during fabrication. The slower processing of higher molecular weight polymers leads to reduced throughput rates, so for example, a commercially viable throughput rate for 45 g/denier UHMW PE fibers is greater than a commercially viable throughput rate for 50 g/denier, 55 g/denier yarns or 60 g/denier yarns. In this regard, a "commercially viable" throughput rate accounts for the cumulative throughput of both the spinning rate of the partially oriented yarn as well as the rate of post drawing the partially oriented yarns. As used herein, the term "tenacity" refers to the tensile stress expressed as force (grams) per unit linear density (denier) of an unstressed specimen. The tenacity of a fiber may be measured by the methods of ASTM D2256.

The gel spinning processes described herein provide for the continuous in-line production of the partially oriented yarn at a spinning rate of from about 25 g/min/yarn end to about 100 g/min/yarn end, depending on the polymer intrinsic viscosity $IV_0$, and wherein the partially oriented yarn may be beneficially post drawn at a rate of at least 3.0 g/minute/yarn end for 45 g/denier UHMW PE yarns, at least 1.5 g/min/yarn end for 50 g/denier UHMW PE yarns, at least 0.8 g/min/yarn end for 55 g/denier UHMW PE yarns, and at least 0.5 g/min/yarn end for 60 g/denier UHMW PE yarns.

Conventional gel spinning processes involve forming of a solution of a polymer and a spinning solvent, passing the solution through a spinneret to form a solution yarn including a plurality of solution filaments (or fibers), cooling the solution yarn to form a gel yarn, removing the spinning solvent to form an essentially dry, solid yarn, and stretching at least one of the solution yarn, the gel yarn and the dry yarn. Forming the solution begins with first forming a slurry that includes the UHME PE polymer starting material and the spinning solvent. The UHMW PE polymer is preferably provided in particulate form prior to combination with the spinning solvent. As has been discussed in U.S. Pat. No. 5,032,338, the particle size and particle size distribution of the particulate UHMW PE polymer can affect the extent to which the UHMW PE polymer dissolves in the spinning solvent during formation of the solution that is to be gel spun. It is desirable that the UHMW PE polymer be completely dissolved in the solution. Accordingly, in one preferred example, the UHMW PE has an average particle size of from about 100 microns (μm) to about 200 μm. In such an example, it is preferred that up to about, or at least about 90% of the UHMW PE particles have a particle size that is within 40 μm of the average UHMW PE particle size. In other words, up to about, or at least about 90% of the UHMW PE particles have a particle size that is equal to the average particle size plus or minus 40 μm. In another example, about 75% by weight to about 100% by weight of the UHMW PE particles utilized can have a particle size of from about 100 μm to about 400 μm, and preferably about 85% by weight to about 100% by weight of the UHMW PE particles have a particle size of from about 120 μm to 350 μm. Additionally, the particle size can be distributed in a substantially Gaussian curve of particle sizes centered at about 125 to 200 μm. It is also preferred that about 75% by weight to about 100% by weight of the UHMW PE particles utilized have a weight average molecular weight of from about 300,000 to about 7,000,000, more preferably from about 700,000 to about 5,000,000. It is also preferred that at least about 40% of the particles be retained on a No. 80 mesh screen.

Preferably, the UHMW PE polymer starting material has fewer than about 5 side groups per 1000 carbon atoms, more preferably fewer than about 2 side groups per 1000 carbon atoms, yet more preferably fewer than about 1 side group per 1000 carbon atoms, and most preferably fewer than about 0.5 side groups per 1000 carbon atoms. Side groups may include but are not limited to $C_1$-$C_{10}$ alkyl groups, vinyl terminated alkyl groups, norbornene, halogen atoms, carbonyl, hydroxyl, epoxide and carboxyl. The UHMW PE may contain small amounts, generally less than about 5 wt. %, preferably less than about 3 wt. % of additives such as antioxidants, thermal stabilizers, colorants, flow promoters, solvents, etc.

The UHMW PE polymer selected for use in the first embodiment of the present gel spinning process preferably has an intrinsic viscosity in decalin at 135° C. of at least about 21 dl/g, preferably greater than about 21 dl/g. The UHME PE polymer preferably has an intrinsic viscosity of from about 21 dl/g to about 100 dl/g, more preferably from about 30 dl/g to about 100 dl/g, more preferably from about 35 dl/g to about 100 dl/g, more preferably from about 40 dl/g to about 100 dl/g, more preferably from about 45 dl/g to about 100 dl/g, more preferably from about 50 dl/g to about 100 dl/g. As used herein throughout, all referenced intrinsic viscosities (IV) are measured in decalin at 135° C.

Preferably, the UHMW PE starting material has a ratio of weight average molecular weight to number average molecular weight ($M_w/M_n$) of 6 or less, more preferably, 5 or less, still more preferably 4 or less, still more preferably 3 or less, still more preferably 2 or less, and even more preferably an $M_w/M_n$ ratio of about 1.

The spinning solvent selected for use in the present gel spinning process can be any suitable spinning solvent, including, but not limited to, a hydrocarbon that has a boiling point over 100° C. at atmospheric pressure. The spinning solvent can be selected from the group consisting of hydrocarbons such as aliphatics, cyclo-aliphatics, and aromatics; and halogenated hydrocarbons such as dichlorobenzene and mixtures thereof. In some examples, the spinning solvent can have a boiling point of at least about 180° C. at atmospheric pressure. In such examples, the spinning solvent can be selected from the group consisting of halogenated hydrocarbons, mineral oil, decalin, tetralin, naphthalene, xylene, toluene, dodecane, undecane, decane, nonane, octene, cis-decahydronaphthalene, trans-decahydronaphthalene, low molecular weight polyethylene wax, and mixtures thereof. Preferably, the solvent is selected from the group consisting of cis-decahydronaphthalene, trans-decahydronaphthalene, decalin, mineral oil and their mixtures. The most preferred spinning solvent is mineral oil, such as HYDROBRITE® 550 PO white mineral oil, commercially available from Sonneborn, LLC of Mahwah, N.J. The HYDROBRITE® 550 PO mineral oil consists of from about 67.5% paraffinic carbon to about 72.0% paraffinic carbon and from about 28.0% to about 32.5% napthenic carbon as calculated according to ASTM D3238.

The components of the slurry can be provided in any suitable manner. For example, the slurry can be formed by combining the UHME PE and the spinning solvent in an agitated mixing tank, followed by providing the combined UHME PE and spinning solvent to an extruder. UHMW PE particles and solvent may be continuously fed to the mixing tank with the slurry formed being discharged to the extruder. The mixing tank may be heated. The slurry can be formed at a temperature that is below the temperature at which the UHME PE will melt and thus also below the temperature at which the UHME PE will dissolve in the spinning solvent. For example, the slurry can be formed at room temperature, or can be heated to a temperature of up to about 110° C. The temperature and residence time of the slurry in the mixing tank are optionally such that the UHMW PE particles will absorb at least 5 weight % of solvent at a temperature below that at which the UHMW PE will dissolve. Preferably, the slurry temperature leaving the mixing tank is from about 40° C. to about 140° C., more preferably from about 80° C. to about 120° C., and most preferably from about 100° C. to about 110° C.

Several alternative modes of feeding the extruder are contemplated. A UHMW PE slurry formed in a mixing tank may be fed to the extruder feed hopper under no pressure. Preferably, a slurry enters a sealed feed zone of the extruder under a positive pressure at least about 20 KPa. The feed pressure enhances the conveying capacity of the extruder. Alternatively, the slurry may be formed in the extruder. In this case, the UHMW PE particles may be fed to an open extruder feed hopper and the solvent is pumped into the extruder one or two barrel sections further forward in the machine.

In yet another alternative feed mode, a concentrated slurry is formed in a mixing tank. This enters the extruder at the feed zone. A pure solvent stream pre-heated to a temperature above the polymer melting temperature enters the extruder several zones further forward. In this mode, some of the process heat duty is transferred out of the extruder and its productive capacity is enhanced.

The extruder to which the slurry is provided can be any suitable extruder, including for example a twin screw extruder such as an intermeshing co-rotating twin screw extruder. Conventional devices, including but not limited to a Banbury Mixer, would also be suitable substitutes for an extruder. The gel spinning process can include extruding the slurry with the extruder to form a mixture, preferably an intimate mixture, of the UHMW PE polymer and the spinning solvent. Extruding the slurry to form the mixture can be done at a temperature that is above the temperature at which the UHMW PE polymer will melt. The mixture of the UHMW PE polymer and the spinning solvent that is formed in the extruder can thus be a liquid mixture of molten UHMW PE polymer and the spinning solvent. The temperature at which the liquid mixture of molten UHMW PE polymer and the spinning solvent is formed in the extruder can be from about 140° C. to about 320° C., preferably from about 200° C. to about 320° C., and more preferably from about 220° C. to about 280° C.

The productivity of the inventive processes and the properties of the articles produced depend in part on the concentration of the UHMW PE solution. Higher polymer concentrations provide the potential for higher productivity but are also more difficult to dissolve in the spinning solvent. Each of the slurry, liquid mixture and solution can include UHMW PE in an amount of from about 1% by weight to about 50% by weight of the solution, preferably from about 1% by weight to about 30% by weight of the solution, more preferably from about 2% by weight to about 20% by weight of the solution, and even more preferably from about 3% by weight to about 10% by weight of the solution. In the most preferred embodiments, the solution includes UHMW PE in an amount of 6.5% or less by weight of the solution (i.e. the weight of the solvent plus the weight of the dissolved polymer), or more particularly 5.0% or less by weight of the solution, or even more preferably 4.0% or less by weight of the solution. Most preferably, the solution includes UHMW PE in an amount of from greater than 3% by weight to less than 6.5% by weight of the solution, or more particularly from greater than 3% by weight to less than 5% by weight based on the weight of the UHMW PE polymer plus the weight of the solvent.

One example of a method for processing the slurry through an extruder is described in commonly-owned U.S. patent application publication 2007/0231572, which describes that the capacity of an extruder scales as approximately the square of the screw diameter. A figure of merit for an extrusion operation is therefore the proportion between the polymer throughput rate and the square of the screw diameter. In at least one example, the slurry is processed such that the extruder throughput rate of UHMW PE polymer in the liquid mixture of molten UHMW PE polymer and spinning solvent is at least the quantity 2.0 $D^2$ grams per minute (g/min), wherein D represents the screw diameter of the extruder in centimeters. For example, the extruder throughput rate of UHMW PE polymer can be 2.5 $D^2$ g/min or more, 5 $D^2$ g/min or more, or 10 $D^2$ g/min or more. The average residence time in an extruder can be defined as the free volume of the extruder (barrel minus screw) divided by the volumetric throughput rate. For example, an average residence time in minutes can be calculated by dividing the free volume in $cm^3$ by the throughput rate in $cm^3$/min.

In the context of the present invention, three alternative methods for the production of UHMW PE yarns having tenacities of at least 45 g/denier at commercially viable throughput rates are provided. In a first embodiment, said yarn is fabricated from an UHMW PE polymer having an intrinsic viscosity ($IV_0$) of at least about 21 dl/g, more preferably at least about 28 dl/g, and still more preferably at least about 30 dl/g, whereby this IV0 is maintained during the gel spinning process such that yarns fabricated therefrom have a yarn intrinsic viscosity ($IV_f$) that exceeds 90% relative to the intrinsic viscosity of the UHMW PE polymer. In a second embodiment, said UHMW PE yarn is fabricated from an UHMW PE polymer having a higher $IV_0$ than in said first embodiment, i.e. an intrinsic viscosity $IV_0$ of at least about 35 dl/g, but wherein the $IV_f$ is not so closely controlled to effectively limit the polymer degradation during processing to less than 10% of the IV0 Each of these alternative methods is effective to achieve the goal of improving production output capacity for high tenacity yarns. In a third embodiment, yarns having a tenacity of greater than 45 g/denier at a denier per filament of 1.4 dpf to 2.2 dpf are fabricated from a low concentration UHMW PE solution having less than 6.5% UHMW PE, preferably from greater than 3% by weight to less than 6.5% by weight of the solution to form 50 g/denier yarns having a denier per filament of 1.4 dpf to 2.2 dpf. The yarns of this third embodiment are not limited to a specific UHMW PE $IV_0$ or $IV_0$ retention percentage.

The intrinsic viscosity of a polymer is a measure of the average molecular weight of the polymer, and UHMW PE yarn tenacity is dependent to an extent on the molecular weight of the UHMW PE polymer. Generally, the higher the UHMW PE molecular weight, the higher the UHMW PE yarn tenacity. However, the conditions of conventional gel spinning processes have a tendency to degrade the UHMW PE polymer, reducing the polymer molecular weight, reducing the polymer intrinsic viscosity $IV_0$ and reducing the maximum achievable yarn tenacity.

In accordance with the first embodiment of the invention, process improvements are made to minimize polymer degradation and fabricate yarns of higher tenacity.

There are many opportunities during each step of the multi-stage gel spinning process to reduce or minimize polymer degradation. For example, the initial stage of the gel spinning process involves the formation of a UHMW PE polymer solution according to the following steps:

1) Formation of a slurry, i.e., a dispersion of solid polymer particles in a solvent capable of dissolving the polymer;
2) Heating the slurry to melt the polymer and to form a liquid mixture under conditions of intense distributive and dispersive mixing to thereby reduce the domain sizes of molten polymer and solvent in the mixture to microscopic dimensions; and
3) Allowing sufficient time for diffusion of the solvent into the polymer and of the polymer into the solvent to occur to thereby form a solution.

Limitation of polymer degradation is possible during each of these steps to maintain the polymer IV0. For example, a study by G. R. Rideal et al. entitled, "The Thermal-Mechanical Degradation of High Density Polyethylene", *J. Poly. Sci., Symposium No* 37, 1-15 (1976) found that the presence of oxygen during polymer processing promoted shear induced chain scission, but that under nitrogen at temperatures less than 290° C., long chain branching and viscosity increase dominated. Accordingly, during any of these stages 1-3, sparging the solvent, the polymer-solvent mixture and/or the solution with nitrogen gas is expected to reduce or entirely eliminate the presence of oxygen and retain polymer $IV_0$. In a preferred embodiment, the slurry is sparged with nitrogen according to any technique that is conventional in the art. Nitrogen sparging is preferably conducted continuously, such as by continuously bubbling nitrogen through the slurry tank. Nitrogen sparging in the slurry tank may take place, for example, at a rate of from about 29 liters/minute to about 58 liters/minute. Other means of reducing or eliminating the presence of oxygen from the polymer-solvent mixture and/or solution during polymer processing should be similarly effective, such as the incorporation of an antioxidant into the polymer-solvent mixture and/or solution. The use of an antioxidant is taught in U.S. Pat. No. 7,736,561, which is commonly owned by Honeywell International Inc. In this embodiment, the concentration of the antioxidant should be sufficient to minimize the effects of adventitious oxygen but not so high as to react with the polymer. The weight ratio of the antioxidant to the solvent is preferably from about 10 parts per million to about 1000 parts per million. Most preferably, the weight ratio of the antioxidant to the solvent is from about 10 parts per million to about 100 parts per million.

Useful antioxidants non-exclusively include hindered phenols, aromatic phosphites, amines and mixtures thereof. Preferred antioxidants include 2,6-di-tert-butyl-4-methylphenol, tetrakis[methylene(3,5-di-tert-butylhydroxyhydrocinnamate)]methane, tris(2,4-di-tert-butylphenyl) phosphite, octadecyl 3,5-di-tert-butyl-4-hyroxyhydrocinnamate, 1,3,5-tris(3,5-di-tert-butyl-4-hydroxybenzyl)-1,3,5-triazine-2,4,6 (1H,3H,5H)-trione, 2,5,7,8 tetramethyl-2(4',8',12'-trimethyltridecyl)chroman-6-ol, and mixtures thereof. More preferably the antioxidant is 2,5,7,8 tetramethyl-2(4',8',12'-trimethyltridecyl)chroman-6-ol, commonly known as Vitamin E or α-tocopherol.

Other additives may also be optionally added to the mix of polymer and solvent, such as processing aids, stabilizers, etc., as may be desirable to maintain polymer molecular weight and $V_0$.

Polymer degradation may also be controlled during these initial stages 1-3 by controlling the harshness of the environment in which the polymer is processed. For example, step 1 is typically conducted by forming the slurry in a slurry mixing tank, whereas steps 2 and/or 3 are often initiated or fully accomplished in an extruder under more intense heat and mixing conditions relative to the slurry mixing tank. Reducing polymer residence time in the extruder is desired to minimize polymer degradation. For example, transformation of the polymer slurry into an intimate mixture of molten polymer and solvent, ideally with domain sizes of microscopic dimensions, requires that the extruder have sufficient heating and distributive mixing capabilities.

The extruder may be a single screw extruder, or it may be a non-intermeshing twin screw extruder or an intermeshing counter-rotating twin screw extruder. Preferably, the extruder is an intermeshing co-rotating twin screw extruder, wherein the screw elements of the intermeshing co-rotating twin screw extruder are preferably forwarding conveying elements, preferably including no back-mixing or kneading segments. While these extruder features are effective for melting the polymer and mixing the melted polymer and solvent to form a liquid mixture, the intense heat and the amount of shear on the polymer is deleterious to the polymer molecular weight. To circumvent this problem while still forming a polymer solution with efficiency, it may be desired to initiate formation of the polymer-solvent liquid mixture by heating the slurry tank, thereby allowing some melt formation in a gentler environment. This in turn will reduce the polymer residence time in the extruder, thereby reducing the polymer thermal and shear degradation. In addition to increasing the residence time of the polymer in the slurry tank, preferably in a heated slurry tank, reducing the extruder temperature will help create the solution in a gentler environment.

As is also known from commonly-owned U.S. patent application publication 2007/0231572, the residence time of the mixture in the extruder may also be limited by promptly passing the polymer-solvent mixture from the extruder and into a heated vessel, where the remaining time needed for the solvent and polymer to completely diffuse into each other and form a uniform, homogenous solution is provided. Operating conditions that can facilitate the formation of a homogeneous solution include, for example, (1) raising the temperature of the liquid mixture of the UHMW PE and the spinning solvent to a temperature near or above the melting temperature of the UHMW PE, and (2) maintaining the liquid mixture at said raised temperature for a sufficient amount of time to allow the spinning solvent to diffuse into the UHMW PE and for the UHMW PE to diffuse into the spinning solvent. When the solution is uniform, or sufficiently uniform, the final gel spun fiber can have improved properties, such as increased tenacity.

Preferably, the average residence time in the extruder, defined as the ratio of free volume in the extruder to the volumetric throughput rate, is less or equal to about 1.5 minutes, more preferably less than or equal to about 1.2 minutes, and most preferably less than or equal to about 1.0 minutes. In the process of first embodiment of the invention, the intrinsic viscosity of the polyethylene in the liquid mixture is reduced in passing through the twin screw extruder in an amount of less than 10%, i.e., from an initial polymer intrinsic viscosity IV0 to a final yarn intrinsic viscosity $IV_f$ of from $0.9\ IV_0 < IV_f \leq 1.0\ IV_0$. In the process of second embodiment of the invention, the initial intrinsic viscosity of the polyethylene in the liquid mixture is at least about 35 dl/g and may be reduced in an amount of greater than 10% in passing through the twin screw extruder, but not to an extent that the final yarn intrinsic viscosity $IV_f$ is less than 21 dl/g.

The liquid mixture of UHMW PE and spinning solvent that exits the extruder can be passed via a pump, such as a positive displacement pump, into the heated vessel. It is preferred that the vessel is a heated pipe. The heated pipe may be a straight length of pipe, or it may have bends, or it may be a helical coil. It may comprise sections of differing length and diameter chosen so that the pressure drop through the pipe is not excessive. As the polymer/solvent mixture entering the pipe is highly pseudoplastic, it is preferred that the heated pipe contains one or more static mixers to redistribute the flow across the pipe cross-section at intervals, and/or to provide additional dispersion. The heated vessel is preferably maintained at a temperature of at least about 140° C., preferably from about 220° C. to about 320° C., and most preferably from about 220° C. to about 280° C. The heated vessel can have a volume sufficient to provide an average residence time of the liquid mixture in the heated vessel to form a solution of the UHMW PE in the solvent. For example, the residence time of the liquid mixture in the heated vessel can be from about 2 minutes to about 120 minutes, preferably from about 6 minutes to about 60 minutes.

In an alternative example, the placement and utilization of the heated vessel and the extruder can be reversed in forming the solution of UHMW PE and spinning solvent. In such an example, a liquid mixture of UHMW PE and spinning solvent can be formed in a heated vessel, and can then be passed through an extruder to form a solution that includes the UHMW PE and the spinning solvent.

Each of these steps is intended to maximize the retention of polymer $IV_0$ prior to extruding the solution through a spinneret to form solution filaments. Further opportunities for intrinsic viscosity retention exist in post-solution processing. After the solution filaments are formed, post-solution processing conventionally includes the following steps:

4) Passing the thus-formed solution through a spinneret to form solution filaments;
5) Passing said solution filaments through a short gaseous space into a liquid quench bath wherein said solution filaments are rapidly cooled to form gel filaments;
6) Removing the solvent from the gel filaments to form solid filaments; and
7) Stretching at least one of the solution filaments, the gel filaments and the solid filaments in one or more stages. As used herein, the terms "drawn" fibers or "drawing" fibers are known in the art, and are also known in the art as "oriented" or "orienting" fibers or "stretched" or "stretching" fibers. These terms are used interchangeably herein. Stretching of solid filaments includes a post-drawing operation to increase final yarn tenacity. See, for example, U.S. Pat. Nos. 6,969,553 and 7,370,395, and U.S. Publications 2005/0093200, 2011/0266710 and 2011/0269359, each of which is incorporated herein to the extent consistent herewith, which describe post-drawing operations that are conducted on partially oriented yarns/fibers to form highly oriented yarns/fibers of higher tenacities. Such post-drawing is typically performed off-line as a decoupled process using separate stretching equipment.

The process of providing the solution of UHMW PE polymer and spinning solvent from the heated vessel to the spinneret can include passing the solution of UHMW PE polymer and spinning solvent through a metering pump, which can be a gear pump. The solution fiber that issues from the spinneret can include a plurality of solution filaments. The spinneret can form a solution fiber having any suitable number of filaments, including for example, at least about 100 filaments, at least about 200 filaments, at least about 400 filaments, or at least about 800 filaments. In one example, the spinneret can have from about 10 spinholes to about 3000 spinholes, and the solution fiber can comprise from about 10 filaments to about 3000 filaments. Preferably, the spinneret can have from about 100 spinholes to about 2000 spinholes and the solution fiber can comprise from about 100 filaments to about 2000 filaments. The spinholes can have a conical entry, with the cone having an included angle from about 15 degrees to about 75 degrees. Preferably, the included angle is from about 30 degrees to about 60 degrees. Additionally, following the conical entry, the spinholes can have a straight bore capillary extending to the exit of the spinhole. The capillary can have a length to diameter ratio of from about 10 to about 100, more preferably from about 15 to about 40.

As the solution filaments pass through the gaseous space, they remain vulnerable to oxidation if the space contains oxygen, such as if the space is filled with air. To minimize polymer degradation and maximize yarn $IV_f$, it may be desired to fill the gaseous space with nitrogen or another inert gas like argon to prevent any oxidization. Limitation of the length gaseous space will also minimize the potential for oxidation, particularly if filling the gap with an inert gas is impractical. The length of the gaseous space between the spinneret and the surface of the liquid quench bath is preferably from about 0.3 cm to about 10 cm, more preferably from about 0.4 cm to about 5 cm. If the residence time of the solution yarn in the gaseous space is less than about 1 second, the gaseous space may be filled with air, otherwise filling the space with an inert gas is most preferred.

The liquid in the quench bath is preferably selected from the group consisting of water, ethylene glycol, ethanol, isopropanol, a water soluble anti-freeze and their mixtures. Preferably, the liquid quench bath temperature is from about −35° C. to about 35 C.

Once the solution filaments are cooled and transformed into gel filaments, the spinning solvent must be removed. Removal of the spinning solution can be accomplished by any suitable method, including, for example, drying, or by extracting the spinning solvent with a low boiling second solvent followed by drying. The requisite technique for removing the spinning solvent depends primarily on the type of spinning solvent employed. For example, a decalin spinning solvent may be removed by evaporation/drying according to techniques that are conventional in the art. On the other hand, a mineral oil spinning solvent must be extracted with a second solvent. Extraction with a second solvent is conducted in a manner that replaces the first solvent in the gel with second solvent without significant changes in gel structure. Some swelling or shrinkage of the gel may occur, but preferably no substantial dissolution, coagulation or precipitation of the polymer occurs. When the first solvent is a hydrocarbon, suitable second solvents include hydrocarbons, chlorinated hydrocarbons, chlorofluorinated hydrocarbons and others, such as pentane, hexane, cyclohexane, heptane, toluene, methylene chloride, carbon tetrachloride, trichlorotrifluoroethane (TCTFE), diethyl ether, dioxane, dichloromethane and combinations thereof. Preferred low boiling second solvents are non-flammable volatile solvents having an atmospheric boiling point below about 80° C., more preferably below about 70° C. and most preferably below about 50° C. The most preferred second solvents are methylene chloride (B.P.=39.8° C.) and TCFE (B.P.=47.5° C.). Conditions of extraction should remove the first solvent to less than 1% of the total solvent in the gel. Following extraction, the extraction solvent may be removed from the fiber by evaporation/drying to form a dry yarn/fiber. The dry fiber preferably includes less than about 10 percent by weight of any solvent, including spinning solvent and any second solvent that is utilized in removing the spinning solvent. Preferably, the dry fiber includes less than about 5 weight percent of solvent, and more preferably less than about 2 weight percent of solvent.

A preferred extraction method using a second solvent is described in detail in commonly owned U.S. Pat. No. 4,536,536, the disclosure of which is incorporated herein by reference. Most preferably, the spinning solvents and extraction solvents are recovered and recycled. Use of a recycled spinning solvent is most specifically preferred as the solvent recovered in the extraction process is highly pure and not contaminated by oxygen.

The gel spinning process can include drawing the solution fiber that issues from the spinneret at a draw ratio of from about 1.1:1 to about 30:1 to form a drawn solution fiber. Stretching of the solution yarn within the gaseous space between the spinneret and the liquid quench bath is influenced by the length of the gaseous space. A longer space may lead to greater stretching of the solution yarns inside the space, so this variable may be controlled as desired if more or less stretching of the solution fiber is desired. The gel spinning process can include drawing the gel fiber in one or more stages at a first draw ratio DR1 of from about 1.1:1 to about 30:1. Drawing the gel fiber in one or more stages at the first draw ratio DR1 can be accomplished by passing the gel fiber through a first set of rolls (rollers). Preferably, drawing the gel fiber at the first draw ratio DR1 can be conducted without applying heat to the fiber, and can be conducted at a temperature less than or equal to about 25° C.

Drawing the gel fiber can also include drawing the gel fiber at a second draw ratio DR2. Drawing the gel fiber at the second draw ratio DR2 can also include simultaneously removing spinning solvent from the gel fiber in a solvent removal device, sometimes referred to as a washer, to form a dry fiber. Accordingly, the second drawing step DR2 may be conducted in the solvent removal device (e.g. the washer). Drawing in the washer is preferred but not mandatory. Preferably, the gel fiber is drawn at a second draw ratio DR2 of about 1.5:1 to about 3.5:1, more preferably at about 1.5:1 to about 2.5:1, and most preferably at about a 2:1 draw ratio.

The gel spinning process can also include drawing the dry yarn at a third draw ratio DR3 in at least one stage to form a partially oriented yarn. Drawing the dry yarn at the third draw ratio can be accomplished, for example, by passing the dry yarn through a draw stand. The third draw ratio can be from about 1.10:1 to about 3.00:1, more preferably from about 1.10:1 to about 2.00:1. Drawing the gel yarn and the dry yarn at draw ratios DR1, DR2 and DR3 can be done in-line. In one example, the combined draw of the gel yarn and the dry yarn, which can be determined by multiplying DR1, DR2 and DR3, and can be written as DR1×DR2×DR3:1 or (DR1)(DR2)(DR3):1, wherein DR1×DR2×DR3:1 can be at least about 5:1, preferably at least about 10:1, more preferably at least about 15:1, and most preferably at least about 20:1. Preferably, the dry yarn is maximally drawn in-line until the last stage of draw is at a draw ratio of less than about 1.2:1. Optionally, the last stage of drawing the dry yarn can be followed by relaxing the partially oriented fiber from about 0.5 percent of its length to about 5 percent of its length.

Preferably, stretching is performed on all three of the solution filaments, the gel filaments and the solid filaments. During the processing of the yarns, stretching is performed on at least one of the solution filaments, the gel filaments and the solid filaments in one or more stages to a combined stretch ratio (draw ratio) of at least about 10:1, wherein a stretch of at least about 2:1 is preferably applied to the solid filaments to form a high strength multi-filament UHMW PE yarn.

Additional post-drawing operations, including further drawing of the yarn, may be conducted as described in commonly-owned U.S. patent application publication 2011/0266710, U.S. Pat. Nos. 6,969,553, 7,370,395 or 7,344,668, each of which is incorporated herein by reference to the extent compatible herewith.

In addition to affecting the requisite solvent extraction method, it has been found that the type of spinning solvent employed also affects the denier of the resulting drawn fibers. As used herein, the term "denier" refers to the unit of linear density, equal to the mass in grams per 9000 meters of fiber or yarn. Yarn denier is determined by both the linear density of each filament forming the yarn, i.e. denier per filament (dpf) and the number of filaments forming the yarn. Generally, once all stretching steps have been completed, fibers/yarns of the invention will have a denier per filament of from about 1.4 dpf to about 2.5 dpf, more preferably from about 1.4 to about 2.2 dpf. While these low dpf ranges are preferred, broader ranges may be useful, wherein the yarn denier per filament preferably ranges from 1.4 dpf to about 15 dpf, more preferably from about 2.2 dpf to about 15 dpf, more preferably from about 2.5 dpf to about 15 dpf. Other useful ranges include about 3 dpf to about 15 dpf, about 4 dpf to about 15 dpf, about 5 dpf to about 15 dpf. In order to obtain yarns comprising fibers having a post-stretching denier per filament as low as 1.4 dpf, the spinning solvent should be an extractable spinning solvent (i.e. a two-solvent system), not an evaporatable spinning solvent (i.e. a one-solvent system). This is because the filament denier must be relatively low in order for the spinning solvent, e.g. decalin, to fully evaporate at a reasonable and commercially viable rate. This specifically excludes decalin as a spinning solvent if yarns comprising filaments of greater than 2 dpf are desired according to the processes described herein, particularly 2.2 dpf or greater, more particularly yarns comprising filaments of 2.5 dpf or greater. Yarns having a denier per filament of ≥2.5 dpf are most preferably fabricated using mineral oil as the spinning solvent.

Multifilament yarns/fibers of the invention preferably include from 2 to about 1000 filaments, more preferably from 30 to 500 filaments, still more preferably from 100 to 500 filaments, and most preferably from about 100 filaments to about 250 filaments. Resulting multi-filament yarns of the invention having the above recited dpf ranges for the component filaments will preferably have a yarn denier ranging from about 50 to about 5000 denier, more preferably from about 100 to 2000 denier and most preferably from about 150 to about 1000 denier.

Collectively, the above options are effectively utilized in the first embodiment of the invention to maintain the intrinsic viscosity $IV_0$ of the UHMW PE polymer such that the intrinsic viscosity $IV_f$ of the UHMW PE yarn exceeds 90% relative to the intrinsic $IV_0$ and wherein the $IV_f$ is greater than 18 dl/g, more preferably at least about 21 dl/g and most preferably is at least about 28 dl/g.

As stated previously, in the second embodiment of the invention, rather than taking efforts to maintain the intrinsic viscosity $IV_0$ of the UHMW PE polymer such that the intrinsic viscosity $IV_f$ of the UHMW PE yarn exceeds 90% relative to the intrinsic $IV_0$, an UHMW PE polymer having the highest obtainable intrinsic viscosity $IV_0$ is used as a starting material and is allowed to degrade to IV levels that are more manageable for drawing processes. For example, an UHMW PE polymer having an $IV_0$ of at least about 35 dl/g, more preferably an intrinsic viscosity of at least about 40 dl/g, still more preferably an intrinsic viscosity of at least about 45 dl/g, and most preferably an intrinsic viscosity of at least about 50 dl/g, is provided and allowed to degrade down to a yarn $IV_f$ of at least about 21 dl/g, more preferably to an a yarn $IV_f$ of at least about 25 dl/g, still more preferably to a yarn $IV_f$ of at least about 30 dl/g, and most preferably to a yarn $IV_f$ of at least about 35 dl/g, wherein said intrinsic viscosities are measured in decalin at 135° C. according to ASTM D1601-99. The higher the yarn $IV_f$, the higher the yarn tenacity. A UHMW PE yarn of the invention having a $IV_f$ of 40 dl/g or greater will have a tenacity of at least about 55 g/denier, more specifically a tenacity of at least about 60 g/denier.

In the third embodiment, yarns having a tenacity of 45 g/denier at a denier per filament of from about 1 dpf to about 4.6 dpf, are fabricated from a low concentration UHMW PE solution having less than 5% UHMW PE by weight that is most preferably dissolved in a mineral oil spinning solvent (or another useful extractable, two solvent system). Most preferably, the UHMW PE concentration in the UHMW PE/spinning solvent solution is from greater than 3% by weight to less than 5% by weight of the solution. The yarns achieved according to this process have a tenacity of 45 g/denier or greater, more preferably 50 g/denier or greater, still more preferably 55 g/denier or greater, and most preferably a tenacity of 60 g/denier or greater. Said yarns have a preferred denier per filament of greater than 2 dpf, more preferably 2.2 dpf or greater, still more preferably 2.5 dpf or greater, and most preferably from 2.5 dpf to 4.6 dpf. The yarns of this third embodiment are not limited to a specific UHMW PE $IV_0$ or $IV_0$ retention percentage. Conducting the gel spinning process at such low UHMW PE concentrations allows the manufacture of partially oriented yarns at a spinning rate up to about 90 grams/min/yarn end.

The gel spinning processes for all the embodiments described above all achieve the ability to produce UHMW PE yarns having tenacities of 45 g/denier and above at commercially viable throughput rates as defined herein. It should be understood, however, that while the process described herein are capable of producing such yarns at said rates, it is not mandatory that the yarns be processed at said rates. The manufacturing process can also include winding the partially oriented yarn as fiber packages, or on a beam, with winders. Winding can preferably be accomplished without twist being imparted to the partially oriented yarn.

It should be understood that all references herein to the term "ultra high" with regard to the molecular weight of the polyolefins or polyethylenes of the invention is not intended to be limiting at the maximum end of polymer viscosity and/or polymer molecular weight. The term "ultra high" is only intended to be limiting at the minimum end of polymer viscosity and/or polymer molecular weight to the extent that useful polymers within the scope of the invention are capable of being processed into fibers having a tenacity of at least 45 g/denier. It should also be understood that while the processes described herein are most preferably applied to the processing of UHMW polyethylene, they are equally applicable to all other poly(alpha-olefins), i.e. UHMW PO polymers.

The fibers described herein may be used to produce ballistic resistant composites and materials, and ballistic resistant articles from said composites and materials. For the purposes of the invention, ballistic resistant composites, articles and materials describe those which exhibit excellent properties against deformable projectiles, such as bullets, and against penetration of fragments, such as shrapnel. The invention particularly provides ballistic resistant composites formed from one or more fiber layers or fiber plies, each layer/ply comprising yarns having a tenacity of at least 45 g/denier or greater. The ballistic resistant composites may comprise woven fabrics, non-woven fabrics or knitted fabrics, where the fibers forming said fabrics may optionally be coated with a polymeric binder material.

A "fiber layer" as used herein may comprise a single-ply of unidirectionally oriented fibers, a plurality of consolidated plies of unidirectionally oriented fibers, a woven fabric, a plurality of consolidated woven fabrics or any other fabric structure that has been formed from a plurality of fibers, including felts, mats and other structures comprising randomly oriented fibers. In this regard, "consolidated" means that a plurality of fiber plies or layers are merged together, usually with a polymeric binder material, to form a single unitary layer. A "layer" generally describes a generally planar arrangement. Each fiber layer will have both an outer top surface and an outer bottom surface. A "single-ply" of unidirectionally oriented fibers comprises an arrangement of fibers that are aligned in a unidirectional, substantially parallel array. This type of fiber arrangement is also known in the art as a "unitape," "unidirectional tape," "UD" or "UDT." As used herein, an "array" describes an orderly arrangement of fibers or yarns, which is exclusive of woven and knitted fabrics, and a "parallel array" describes an orderly, side-by-side, coplanar parallel arrangement of fibers or yarns. The term "oriented" as used in the context of "oriented fibers" refers to the alignment direction of the fibers rather than to stretching of the fibers. The term "fabric" describes structures that may include one or more fiber plies, with or without consolidation/molding of the plies and may relate to a woven material, a non-woven material, or a combination thereof. For example, a non-woven fabric formed from unidirectional fibers typically comprises a plurality of non-woven fiber plies that are stacked on each other in a substantially coextensive fashion and consolidated. When used herein, a "single-layer" structure refers to any monolithic fibrous structure composed of one or more individual plies or individual layers that have been merged by consolidation or molding techniques into a single unitary structure. The term "composite" refers to combinations of fibers, optionally but preferably with a polymeric binder material.

The filaments/fibers/yarns of the invention are preferably at least partially coated with a polymeric binder material, also commonly known in the art as a "polymeric matrix" material, to form a fibrous composite. The terms "polymeric binder" and "polymeric matrix" are used interchangeably herein. These terms are conventionally known in the art and describe a material that binds fibers together either by way of its inherent adhesive characteristics or after being subjected to well known heat and/or pressure conditions. As used herein, a "polymeric" binder or matrix material includes resins and rubber. Such a "polymeric matrix" or "polymeric binder" material may also provide a fabric with other desirable properties, such as abrasion resistance and resistance to deleterious environmental conditions, so it may be desirable to coat the fibers with such a binder material even when its binding properties are not important, such as with woven fabrics.

Suitable polymeric binder materials include both low tensile modulus, elastomeric materials and high tensile modulus, rigid materials. As used herein throughout, the term tensile modulus means the modulus of elasticity, which for polymeric binder materials is measured by ASTM D638. A low or high modulus binder may comprise a variety of polymeric and non-polymeric materials. For the purposes of this invention, a low modulus elastomeric material has a tensile modulus measured at about 6,000 psi (41.4 MPa) or less according to ASTM D638 testing procedures. A low modulus polymer preferably is an elastomer having a tensile modulus of about 4,000 psi (27.6 MPa) or less, more preferably about 2400 psi (16.5 MPa) or less, still more preferably 1200 psi (8.23 MPa) or less, and most preferably is about 500 psi (3.45 MPa) or less. The glass transition temperature (Tg) of the low modulus elastomeric material is preferably less than about 0° C., more preferably the less than about −40° C., and most preferably less than about −50° C. The low modulus elastomeric material also has a preferred elongation to break of at least about 50%, more preferably at least about 100% and most preferably at least about 300%.

A wide variety of materials and formulations may be utilized as a low modulus polymeric binder. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, fluoroelastomers, silicone elastomers, copolymers of ethylene, polyamides (useful with some fiber types), acrylonitrile butadiene styrene, polycarbonates, and combinations thereof, as well as other low modulus polymers and copolymers curable below the melting point of the fiber. Also useful are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers.

Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type $R-(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. Also useful are resin dispersions of styrene-isoprene-styrene (SIS) block copolymer sold under the trademark PRINLIN® and commercially available from Henkel Technologies, based in Dusseldorf, Germany. Conventional low modulus polymeric binder polymers employed in ballistic resistant composites include polystyrene-polyisoprene-polystyrene-block copolymers sold under the trademark KRATON® commercially produced by Kraton Polymers.

While low modulus polymeric binder materials are preferred for the formation of flexible armor materials, high modulus polymeric binder materials are preferred for the formation of rigid armor articles. High modulus, rigid materials generally have an initial tensile modulus greater than 6,000 psi. Useful high modulus, rigid polymeric binder materials include polyurethanes (both ether and ester based), epoxies, polyacrylates, phenolic/polyvinyl butyral (PVB) polymers, vinyl ester polymers, styrene-butadiene block copolymers, as well as mixtures of polymers such as vinyl ester and diallyl phthalate or phenol formaldehyde and polyvinyl butyral. A particularly useful rigid polymeric binder material is a thermosetting polymer that is soluble in carbon-carbon saturated solvents such as methyl ethyl ketone, and possessing a high tensile modulus when cured of at least about $1\times10^6$ psi (6895 MPa) as measured by ASTM D638. Particularly useful rigid polymeric binder materials are those described in U.S. Pat. No. 6,642,159, the disclosure of which is incorporated herein by reference.

Most specifically preferred are polar resins or polar polymers, particularly polyurethanes within the range of both soft and rigid materials at a tensile modulus ranging from about 2,000 psi (13.79 MPa) to about 8,000 psi (55.16 MPa). Preferred polyurethanes are applied as aqueous polyurethane dispersions that are most preferably, but not necessarily, cosolvent free. Such includes aqueous anionic polyurethane dispersions, aqueous cationic polyurethane dispersions and aqueous nonionic polyurethane dispersions. Particularly preferred are aqueous anionic polyurethane dispersions; aqueous aliphatic polyurethane dispersions, and most preferred are aqueous anionic, aliphatic polyurethane dispersions, all of which are preferably cosolvent free dispersions. Such includes aqueous anionic polyester-based polyurethane dispersions; aqueous aliphatic polyester-based polyurethane dispersions; and aqueous anionic, aliphatic polyester-based polyurethane dispersions, all of which are preferably cosolvent free dispersions. Such also includes aqueous anionic polyether polyurethane dispersions; aqueous aliphatic polyether-based polyurethane dispersions; and aqueous anionic, aliphatic polyether-based polyurethane dispersions, all of which are preferably cosolvent free dispersions. Similarly preferred are all corresponding variations (polyester-based; aliphatic polyester-based; polyether-based; aliphatic polyether-based, etc.) of aqueous cationic and aqueous nonionic dispersions. Most preferred is an aliphatic polyurethane dispersion having a modulus at 100% elongation of about 700 psi or more, with a particularly preferred range of 700 psi to about 3000 psi. More preferred are aliphatic polyurethane dispersions having a modulus at 100% elongation of about 1000 psi or more, and still more preferably about 1100 psi or more. Most preferred is an aliphatic, polyether-based anionic polyurethane dispersion having a modulus of 1000 psi or more, preferably 1100 psi or more. The rigidity, impact and ballistic properties of the articles formed from the fabric composites of the invention are affected by the tensile modulus of the polymeric binder polymer coating the fibers.

The rigidity, impact and ballistic properties of the articles formed from the fabric composites of the invention are affected by the tensile modulus of the polymeric binder polymer coating the fibers. For example, U.S. Pat. No. 4,623,574 discloses that fiber reinforced composites constructed with elastomeric matrices having tensile moduli less than about 6,000 psi (41,300 kPa) have superior ballistic properties compared both to composites constructed with higher modulus polymers, and also compared to the same fiber structure without a polymeric binder material. However, low tensile modulus polymeric binder material polymers also yield lower rigidity composites. Further, in certain applications, particularly those where a composite must function in both anti-ballistic and structural modes, there is needed a superior combination of ballistic resistance and rigidity. Accordingly, the most appropriate type of polymeric binder polymer to be used will vary depending on the type of article to be formed from the fabrics of the invention. In order to achieve a compromise in both properties, a suitable polymeric binder may combine both low modulus and high modulus materials to form a single polymeric binder.

Methods for applying a polymeric binder material to fibers to thereby impregnate fiber plies/layers with the binder are well known and readily determined by one skilled in the art. The term "impregnated" is considered herein as being synonymous with "embedded," "coated," or otherwise applied with a polymeric coating where the binder material diffuses into the fiber ply/layer and is not simply on a surface of the ply/layer. Any appropriate application method may be utilized to directly apply the polymeric binder material to the fiber and particular use of a term such as "coated" is not intended to limit the method by which it is applied onto the filaments/fibers. Useful methods include, for example, spraying, extruding or roll coating polymers or polymer solutions onto the fibers, as well as transporting the fibers through a molten polymer or polymer solution.

Alternately, the polymeric binder material may be extruded onto the fibers using conventionally known techniques, such as through a slot-die, or through other techniques such as direct gravure, Meyer rod and air knife systems, which are well known in the art. Another method is to apply a neat polymer of the binder material onto fibers either as a liquid, a sticky solid or particles in suspension or as a fluidized bed. Alternatively, the coating may be applied as a solution, emulsion or dispersion in a suitable solvent which does not adversely affect the properties of fibers at the temperature of application. For example, the fibers can be transported through a solution of the polymeric binder material to substantially coat the fibers and then dried.

Generally, a polymeric binder coating is necessary to efficiently merge, i.e. consolidate, a plurality of non-woven fiber plies. The polymeric binder material may be applied onto the entire surface area of the individual fibers or only onto a partial surface area of the fibers. Most preferably, the coating of the polymeric binder material is applied onto substantially all the surface area of each individual fiber forming a woven or non-woven fabric of the invention, substantially coating each of the individual filaments/fibers forming a fiber ply or fiber layer. Where the fabrics comprise a plurality of yarns, each filament forming a single strand of yarn is preferably coated with the polymeric binder material. However, as is the case with woven fabric substrates, non-woven fabrics may also be coated with additional polymeric binder/matrix materials after the aforementioned consolidation/molding steps onto one or more surfaces of the fabric as may be desired by one skilled in the art. Most preferred are methods that substantially coat or encapsulate each of the individual fibers and cover all or substantially all of the fiber surface area with the polymeric binder material, wherein the fibers are thereby coated on, impregnated with, embedded in, or otherwise applied with the coating When coating filaments/fibers/yarns with a polymeric binder, the polymeric binder coating may be applied either simultaneously or sequentially to a plurality of fibers. The fibers may be coated prior to forming a fabric or after forming a fabric. For example, fibers may coated when in the form of a fiber web (e.g. a parallel array or a felt) to form a coated web, or may be coated onto at least one array of fibers that is not part of a fiber web to form a coated array. The fibers may also be coated after being woven into a woven fabric to form a coated woven fabric. In this regard, coating woven fiber layers with a polymeric binder is generally not required, but woven fiber layers are preferably coated with a polymeric binder when it is desired to consolidate a plurality of woven fiber layers into a single-layer structure similar to that conducted when consolidating non-woven fiber layers. The invention is not intended to be limited by the stage at which the polymeric binder is applied to the fibers, nor by the means used to apply the polymeric binder.

When a binder is used, the total weight of the binder in a composite preferably comprises from about 2% to about 50% by weight, more preferably from about 5% to about 30%, more preferably from about 7% to about 20%, and most preferably from about 11% to about 16% by weight of the fibers plus the weight of the binder. A lower binder content is appropriate for woven/knitted fabrics, wherein a polymeric binder content of greater than zero but less than 10% by weight of the fibers plus the weight of the binder is typically most preferred, but this is not intended as strictly limiting. For example, phenolic/PVB impregnated woven aramid fabrics are sometimes fabricated with a higher resin content of from about 20% to about 30%, although about 12% content is typically preferred. Whether a low modulus material or a high modulus material, the polymeric binder may also include fillers such as carbon black or silica, may be extended with oils, or may be vulcanized by sulfur, peroxide, metal oxide or radiation cure systems as is well known in the art.

Methods of forming woven fabrics, non-woven fabrics and knitted fabrics are well known in the art. Woven fabrics may be formed using techniques that are well known in the art using any fabric weave, such as plain weave, crowfoot weave, basket weave, satin weave, twill weave, three dimensional woven fabrics, and any of their several variations. Plain weave is most common, where fibers are woven together in an orthogonal 0°/90° orientation, and is preferred. More preferred are plain weave fabrics having an equal warp and weft count. In one embodiment, a single layer of woven fabric preferably has from about 15 to about 55 fiber/yarn ends per inch (about 5.9 to about 21.6 ends per cm) in both the warp and fill directions, and more preferably from about 17 to about 45 ends per inch (about 6.7 to about 17.7 ends per cm). The fibers/yarns forming the woven fabric preferably have a denier of from about 375 to about 1300. The result is a woven fabric weighing preferably from about 5 to about 19 ounces per square yard (about 169.5 to about 644.1 g/m$^2$), and more preferably from about 5 to about 11 ounces per square yard (about 169.5 to about 373.0 g/m$^2$).

Knitted fabric structures are fabricated according to conventional methods, and are preferably oriented knitted structures having straight inlaid yarns held in place by fine denier knitted stitches. Coating woven or knitted fabrics with a polymeric binder will facilitate merging a plurality of woven/knitted fabric layers or merging with other woven/knitted or non-woven composites. Typically, weaving or knitting of fabrics is performed prior to coating the fibers with an optional polymeric binder, where the fabrics are thereafter impregnated with the binder. Multiple woven or knitted fabrics may be interconnected with each other using 3D weaving methods, such as by weaving warp and weft threads into a stack of woven fabrics both horizontally and vertically. A plurality of woven fabrics may also be attached to each other by other means, such as adhesive attachment via an intermediate adhesive film between fabrics, mechanical attachment by stitching/needle punching fabrics together in the z-direction, or a combination thereof. Most preferably, a woven composite of the invention is formed by impregnating/coating a plurality of individual woven fabric layers with a polymeric binder followed by stacking a plurality of the impregnated fabrics on each other in a substantially coextensive fashion, and then merging the stack into a single-layer structure by low pressure consolidation or high pressure molding. Such a woven composite will typically include from about from about 2 to about 100 of these woven fabric layers, more preferably from about 2 to about 85 layers, and most preferably from about 2 to about 65 woven fabric layers. Again, similar techniques and preferences apply to merging a plurality of knitted fabrics.

A non-woven composite of the invention may be formed by conventional methods in the art. For example, in a preferred method of forming a non-woven fabric, a plurality of fibers are arranged into at least one array, typically being arranged as a fiber web comprising a plurality of fibers aligned in a substantially parallel, unidirectional array. In a typical process, fiber bundles are supplied from a creel and led through guides and one or more spreader bars into a collimating comb. This is typically followed by coating the fibers with a polymeric binder material. A typical fiber bundle will have from about 30 to about 2000 individual fibers. The spreader bars and collimating comb disperse and spread out the bundled fibers, reorganizing them side-by-side in a coplanar fashion. Ideal fiber spreading results in the individual filaments or individual fibers being positioned next to one another in a single fiber plane, forming a substantially unidirectional, parallel array of fibers without fibers overlapping each other. Similar to woven fabrics, a single ply of woven fabric preferably has from about 15 to about 55 fiber/yarn ends per inch (about 5.9 to about 21.6 ends per cm), and more preferably from about 17 to about 45 ends per inch (about 6.7 to about 17.7 ends per cm). A 2-ply 0°/90° non-woven fabric will have the same number of fiber/yarn ends per inch in both directions. The fibers/yarns forming the non-woven plies also preferably have a denier of from about 375 to about 1300.

Next, if the fibers are coated, the coating is typically dried followed by forming the coated fibers into a single-ply of a desired length and width. Uncoated fibers may be bound together with an adhesive film, by bonding the fibers together with heat, or any other known method, to thereby form a single-ply. Several of these non-woven, single-plies are then stacked on top of each other in coextensive fashion and merged together.

Most typically, non-woven fabric layers include from 1 to about 6 plies, but may include as many as about 10 to about 20 plies as may be desired for various applications. The greater the number of plies translates into greater ballistic resistance, but also greater weight. A non-woven composite will typically include from about from about 2 to about 100 of these fabric layers, more preferably from about 2 to about 85 layers, and most preferably from about 2 to about 65 non-woven fabric layers.

As is conventionally known in the art, excellent ballistic resistance is achieved when individual fiber plies that are coextensively stacked upon each other are cross-plied such that the such that the unidirectionally oriented fibers in each fibrous ply are oriented in a non-parallel longitudinal fiber direction relative to the longitudinal fiber direction of each adjacent ply. Most preferably, the fiber plies are cross-plied orthogonally at 0° and 90° angles, but adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,574; and 4,737,402, all of which are incorporated herein by reference to the extent not incompatible herewith. Typically, the fibers in adjacent plies will be oriented at an angle of from 45° to 90°, preferably 60° to 90°, more preferably 80° to 90° and most preferably at about 90° relative to each other, where the angle of the fibers in alternate layers is preferably substantially the same.

Methods of consolidating fabrics or fiber plies are well known, such as by the methods described in U.S. Pat. No. 6,642,159. When forming composites of the invention, conventional conditions in the art are used to merge the individual plies/layers into single-layer composite structures. Merging using no pressure or low pressure is often referred to in the art as "consolidation" while high pressure merging is often referred to as "molding," but these terms are frequently used interchangeably. Each stack of overlapping non-woven fiber plies, woven fabric layers or knitted fabric layers is merged under heat and pressure, or by adhering the coatings of individual fiber plies, to form a single-layer, monolithic element. Consolidation can occur via drying, cooling, heating, pressure or a combination thereof. Heat and/or pressure may not be necessary, as the fibers or fabric layers may just be glued together, as is the case in a wet lamination process. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that the polymeric binder coating can be caused to stick or flow without completely melting. However, generally, if the polymeric binder material is caused to melt, relatively little pressure is required to form the composite, while if the binder material is only heated to a sticking point, more pressure is typically required. As is conventionally known in the art, consolidation may be conducted in a calender set, a flat-bed laminator, a press or in an autoclave. Consolidation may also be conducted by vacuum molding the material in a mold that is placed under a vacuum. Vacuum molding technology is well known in the art. Most commonly, a plurality of orthogonal fiber webs are "glued" together with the binder polymer and run through a flat bed laminator to improve the uniformity and strength of the bond. Further, the consolidation and polymer application/bonding steps may comprise two separate steps or a single consolidation/lamination step.

Alternately, consolidation may be achieved by molding under heat and pressure in a suitable molding apparatus. Generally, molding is conducted at a pressure of from about 50 psi (344.7 kPa) to about 5,000 psi (34,470 kPa), more preferably about 100 psi (689.5 kPa) to about 3,000 psi (20,680 kPa), most preferably from about 150 psi (1,034 kPa) to about 1,500 psi (10,340 kPa). Molding may alternately be conducted at higher pressures of from about 5,000 psi (34,470 kPa) to about 15,000 psi (103,410 kPa), more preferably from about 750 psi (5,171 kPa) to about 5,000 psi, and more preferably from about 1,000 psi to about 5,000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. and most preferably at a temperature from about 200° F. to about 280° F. The pressure under which the fiber layers are molded has a direct effect on the stiffness or flexibility of the resulting molded product. Particularly, the higher the pressure at which they are molded, the higher the stiffness, and vice-versa. In addition to the molding pressure, the quantity, thickness and composition of the fiber plies and polymeric binder coating type also directly affects the stiffness of composite.

While each of the molding and consolidation techniques described herein are similar, each process is different. Particularly, molding is a batch process and consolidation is a generally continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft (flexible) body armor fabrics. Molding is typically reserved for the manufacture of hard armor, e.g. rigid plates. In either process, suitable temperatures, pressures and times are generally dependent on the type of polymeric binder coating materials, polymeric binder content, process used and fiber type.

The thickness of each fabric/composite formed herein will correspond to the thickness of the individual fibers and the number of fiber plies/layers incorporated into the composite. For example, a preferred woven/knitted fabric composite will have a preferred thickness of from about 25 μm to about 600 μm per ply/layer, more preferably from about 50 μm to about 385 μm and most preferably from about 75 μm to about 255 μm per ply/layer. A preferred two-ply non-woven fabric composite will have a preferred thickness of from about 12 μm to about 600 μm, more preferably from about 50 μm to about 385 μm and most preferably from about 75 μm to about 255 μm. While such thicknesses are preferred, it is to be understood that other thicknesses may be produced to satisfy a particular need and yet fall within the scope of the present invention.

Following formation of the individual layers or following consolidation of multiple layers into a single-layer consolidated article, polymer layer may optionally be attached to each of the outer surfaces of the composites via conventional methods. Suitable polymers for said polymer layer non-exclusively include thermoplastic and thermosetting polymers. Suitable thermoplastic polymers non-exclusively may be selected from the group consisting of polyolefins, polyamides, polyesters, polyurethanes, vinyl polymers, fluoropolymers and co-polymers and mixtures thereof. Of these, polyolefin layers are preferred. The preferred polyolefin is a polyethylene. Non-limiting examples of polyethylene films are low density polyethylene (LDPE), linear low density polyethylene (LLDPE), linear medium density polyethylene (LMDPE), linear very-low density polyethylene (VLDPE), linear ultra-low density polyethylene (ULDPE), high density polyethylene (HDPE). Of these, the most preferred polyethylene is LLDPE. Suitable thermosetting polymers non-exclusively include thermoset allyls, aminos, cyanates, epoxies, phenolics, unsaturated polyesters, bismaleimides, rigid polyurethanes, silicones, vinyl esters and their copolymers and blends, such as those described in U.S. Pat. Nos. 6,846,758, 6,841,492 and 6,642,159, all of which are incorporated herein by reference to the extent not incompatible herewith. As described herein, a polymer film includes polymer coatings. Also suitable as outer polymer films are ordered discontinuous thermoplastic nets, and non-woven discontinuous fabrics or scrims. Examples are heat-activated, non-woven, adhesive webs such as SPUNFAB® webs, commercially available from Spunfab, Ltd, of Cuyahoga Falls, Ohio (trademark registered to Keuchel Associates, Inc.); THERMOPLAST™ and HELIOPLAST™ webs, nets and films, commercially available from Protechnic S.A. of Cernay, France, as well as others. Any thermoplastic polymer layers are preferably very thin, having preferred layer thicknesses of from about 1 μm to about 250 μm, more preferably from about 5 μm to about 25 μm and most preferably from about 5 μm to about 9 μm. Discontinuous webs such as SPUNFAB® non-woven webs are preferably applied with a basis weight of 6 grams per square meter (gsm). While such thicknesses are preferred, it is to be understood that other thicknesses may be produced to satisfy a particular need and yet fall within the scope of the present invention.

The polymer film layers are preferably attached to the single-layer, consolidated network using well known lamination techniques. Typically, laminating is done by positioning the individual layers on one another under conditions of sufficient heat and pressure to cause the layers to combine into a unitary film. The individual layers are positioned on one another, and the combination is then typically passed through the nip of a pair of heated laminating rolls by techniques well known in the art. Lamination heating may be done at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. If included, the polymer film layers preferably comprise from about 2% to about 25% by weight of the overall fabric, more preferably from about 2% to about 17% percent by weight of the overall fabric and most preferably from 2% to 12%. The percent by weight of the polymer film layers will generally vary depending on the number of fabric layers included. Further, while the consolidation and outer polymer layer lamination steps are described herein as two separate steps, they may alternately be combined into a single consolidation/lamination step via conventional techniques in the art.

The composites of the invention also exhibit good peel strength. Peel strength is an indicator of bond strength between fiber layers. As a general rule, the lower the matrix polymer content, the lower the bond strength, but the higher the fragment resistance of the material. However, below a critical bond strength, the ballistic material loses durability during material cutting and assembly of articles, such as a vest, and also results in reduced long term durability of the articles. In the preferred embodiment, the peel strength for the inventive fabrics in a SPECTRA® Shield)(0°,90° type configuration is preferably at least about 0.17 lb/ft$^2$, more preferably at least about 0.188 lb/ft$^2$, and more preferably at least about 0.206 lb/ft$^2$. It has been found that the best peel strengths are achieved for fabrics of the invention having at least about 11%.

The fabrics of the invention will have a preferred areal density of from about 20 grams/m$^2$ (0.004 lb/ft$^2$ (psf)) to about 1000 gsm (0.2 psf). More preferable areal densities for the fabrics of this invention will range from about 30 gsm (0.006 psf) to about 500 gsm (0.1 psf). The most preferred areal density for fabrics of this invention will range from about 50 gsm (0.01 psf) to about 250 gsm (0.05 psf). Articles of the invention comprising multiple individual layers of fabric stacked one upon the other will further have a preferred areal density of from about 1000 gsm (0.2 psf) to about 40,000 gsm (8.0 psf), more preferably from about 2000 gsm (0.40 psf) to about 30,000 gsm (6.0 psf), more preferably from about 3000 gsm (0.60 psf) to about 20,000 gsm (4.0 psf), and most preferably from about 3750 gsm (0.75 psf) to about 10,000 gsm (2.0 psf).

The fabrics of the invention may be used in various applications to form a variety of different ballistic resistant articles using well known techniques. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758, all of which are incorporated herein by reference to the extent not incompatible herewith. The composites are particularly useful for the formation of flexible, soft armor articles, including garments such as vests, pants, hats, or other articles of clothing, and covers or blankets, used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devises encountered in a military and peace keeping missions.

As used herein, "soft" or "flexible" armor is armor that does not retain its shape when subjected to a significant amount of stress. The structures are also useful for the formation of rigid, hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. The structures can be cut into a plurality of discrete sheets and stacked for formation into an article or they can be formed into a precursor which is subsequently used to form an article. Such techniques are well known in the art.

Garments of the invention may be formed through methods conventionally known in the art. Preferably, a garment may be formed by adjoining the ballistic resistant articles of the invention with an article of clothing. For example, a vest may comprise a generic fabric vest that is adjoined with the ballistic resistant structures of the invention, whereby the inventive structures are inserted into strategically placed pockets. This allows for the maximization of ballistic protection, while minimizing the weight of the vest. As used herein, the terms "adjoining" or "adjoined" are intended to include attaching, such as by sewing or adhering and the like, as well as un-attached coupling or juxtaposition with another fabric, such that the ballistic resistant articles may optionally be easily removable from the vest or other article of clothing. Articles used in forming flexible structures like flexible sheets, vests and other garments are preferably formed from using a low tensile modulus binder material. Hard articles like helmets and armor are preferably, but not exclusively, formed using a high tensile modulus binder material.

Ballistic resistance properties are determined using standard testing procedures that are well known in the art. Particularly, the protective power or penetration resistance of a ballistic resistant composite is normally expressed by citing the impacting velocity at which 50% of the projectiles penetrate the composite while 50% are stopped by the composite, also known as the $V_{50}$ value. As used herein, the "penetration resistance" of an article is the resistance to penetration by a designated threat, such as physical objects including bullets, fragments, shrapnel and the like. For composites of equal areal density, which is the weight of the composite divided by its area, the higher the $V_{50}$, the better the ballistic resistance of the composite.

The penetration resistance for designated threats can also be expressed by the total specific energy absorption ("SEAT") of the ballistic resistant material. The total SEAT is the kinetic energy of the threat divided by the areal density of the composite. The higher the SEAT value, the better the resistance of the composite to the threat. The ballistic resistant properties of the articles of the invention will vary depending on many factors, particularly the type of fibers used to manufacture the fabrics, the percent by weight of the fibers in the composite, the suitability of the physical properties of the coating materials, the number of layers of fabric making up the composite and the total areal density of the composite.

The following examples serve to illustrate the invention.

EXAMPLE 1

Comparative

A spinning solvent and an UHMW PE polymer were mixed to form a slurry inside of a slurry tank that is heated to 100° C. The UHMW PE polymer had an intrinsic viscosity $IV_0$ of about 30 dl/g. A solution was formed from the slurry in an extruder set at an extruder temperature of 280° C. and in a heated vessel set at a temperature of 290° C. The concentration of the polymer in the slurry entering the extruder was about 8%. After forming a homogenous spinning solution via the extruder and the heated vessel, the solution was spun through a 240 hole spinneret, through a 1.5 inch (3.8 cm) long air gap, and into a water quench bath. The holes of the spinneret have hole diameters of 0.35 mm and Length/Diameter (L/D) ratios of 30:1. The solution yarn was stretched in the 1.5 inch air gap at a draw ratio of about 2:1 and then quenched in the water bath having a water temperature of about 10° C. The gel yarn was cold stretched with sets of rolls at a 3:1 draw ratio before entering into a solvent removal device. In the solvent removal device, wherein the solvent was extracted with an extraction solvent, the gel fiber was drawn at about a 2:1 draw ratio. The resulting dry yarn, which had a yarn $IV_f$ of 16 dl/g, was drawn by four sets of rollers at three stages to form a partially oriented yarn (POY) with a tenacity of about 20 g/denier. The POY was drawn at 150° C. within a 25 meter oven. The feed speed of the POY was 6.7 meter/min and the take up speed was about 30 m/min. The tenacity of the highly oriented yarn (HOY) produced was 45 g/d, with a modulus of about 1350 g/d.

EXAMPLE 2

Example 1 is repeated except the slurry tank was sparged continuously with a tube feeding nitrogen into the tank at a rate of at least about 2.4 liters/minute. The nitrogen was sparged under the slurry to bubble out as much as oxygen as possible to prevent IV degradation. The POY yarn made with this process had a 4 dl/g increase in IV (from 16 dl/g to 20 dl/g) compared to Example 1, with a polymer $IV_0$ of about 30 dl/g. This high IV POY yarn was then drawn via the same drawing process as in Example 1 to produce an HOY yarn having a tenacity of about 50 g/d and a tensile modulus of about 1620 g/d.

EXAMPLE 3

A POY yarn was made according to the process of Example 2 except the concentration of the polymer in the slurry entering the extruder was about 5% instead of 8%. The lower polymer concentration helps maintain the IV during the spinning process. The POY yarn IV in this case was 21.2 dl/g.

EXAMPLE 4

A POY yarn was made as in Example 2, except the extruder temperature was dropped from 280° C. to 240° C. The POY yarn had an IV of 23.7 dl/g, an increase of 8 dl/g relative to Example 1. This 23.7 dl/g POY yarn may then be drawn according to the drawing conditions of U.S. Pat. No. 7,344,668 to form a highly oriented yarn (HOY) having a tenacity of greater than 50 g/d and the tensile modulus is greater than 1650 g/d.

EXAMPLE 5

A POY yarn is made as in Example 3 but with a UHMW PE polymer having a starting $IV_0$ of 40 dl/g and with a polymer concentration in the slurry of about 3% by weight. The POY yarn made under these conditions is about 30 dl/g. This 30 dl/g POY yarn is then drawn according to the drawing conditions of U.S. Pat. No. 7,344,668 to form a highly oriented yarn (HOY) having a tenacity of 55 g/d and tensile modulus of about 1700 g/d.

EXAMPLE 6

A POY yarn is made as in Example 4 but the rpm of the extruder is dropped from 300 rpm to 220 rpm and an additive such as 2,5,7,8 tetramethyl-2(4',8',12'-trimethyltridecyl)chroman-6-ol is added to prevent IV degradation. The POY yarn thus made has an IV of 35 dl/g. This high IV POY yarn is then drawn according to the drawing conditions of U.S. Pat. No. 7,344,668 to form a highly oriented yarn (HOY) having a tenacity of 60 g/d and a tensile modulus of about 1850 g/d.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A process for producing an ultra-high molecular weight polyethylene (UHMW PE) multi-filament yarn having a tenacity of at least 45 g/denier, wherein said yarn is fabricated from an UHMW PE polymer having an intrinsic viscosity of at least about 21 dl/g and a yarn intrinsic viscosity that exceeds 90% relative to the intrinsic viscosity of the UHMW PE polymer; wherein said intrinsic viscosities are measured in decalin at 135° C. according to ASTM D1601-99, the process comprising:

a) providing a mixture comprising an UHMW PE polymer and a spinning solvent, said UHMW PE polymer having an intrinsic viscosity of at least about 21 dl/g as measured in decalin at 135° C. according to ASTM D1601-99;

b) forming a solution from said mixture;

c) passing the solution through a spinneret to form a plurality of solution filaments;

d) cooling the solution filaments to a temperature below the gel point of the UHMW PE polymer to thereby form a gel yarn;

e) removing the spinning solvent from the gel yarn to form a dry yarn; and f) stretching at least one of the solution filaments, the gel filaments and the solid filaments in one or more stages to form a yarn product having a tenacity of greater than 45 g/d, and wherein said yarn product has an intrinsic viscosity that exceeds 90% relative to the intrinsic viscosity of the UHMW PE polymer; wherein said intrinsic viscosities are measured in decalin at 135° C. according to ASTM D1601-99.

2. The process of claim 1 wherein the yarn is fabricated from an UHMW PE polymer having an intrinsic viscosity of 21 dl/g or more.

3. The process of claim 1 wherein the yarn intrinsic viscosity is at least about 28 dl/g.

4. The process of claim 1 wherein said process further comprises adding an antioxidant to said mixture and/or to said solution.

5. The process of claim 1 wherein said process further comprises sparging said mixture or said solution with nitrogen prior to step c).

6. The process of claim 1 wherein the post-drawn, highly oriented yarn product is produced at a throughput rate of at least about 3.0 g/min/yarn end for a yarn product having a tenacity of 45 g/d.

7. The process of claim 1 wherein the yarn is fabricated from a composition comprising a blend of an UHMW PE polymer and a solvent, wherein the UHMW PE polymer is present in said blend in an amount of less than 5% by weight based on the weight of the solvent plus the UHMW PE polymer.

8. The process of claim 1 wherein said process further comprises adding an antioxidant to said mixture and/or to said solution and sparging said mixture or said solution with nitrogen prior to step c).

9. A process for producing an ultra-high molecular weight polyethylene (UHMW PE) multi-filament yarn, comprising:

a) providing a mixture comprising a UHMW PE polymer and a spinning solvent, wherein the UHMW PE polymer is present in said mixture in an amount of less than 5.0% by weight based on the weight of the solvent plus the weight of the UHMW PE polymer;

b) forming a solution from said mixture;

c) passing the solution through a spinneret to form a plurality of solution filaments;

d) cooling the solution filaments to a temperature below the gel point of the UHMW PE polymer to thereby form a gel yarn;

e) removing the spinning solvent from the gel yarn to form a dry yarn; and f) stretching at least one of the solution filaments, the gel filaments and the solid filaments in one or more stages to form a yarn product.

10. The process of claim 9 wherein said process further comprises adding an antioxidant to said mixture and/or to said solution.

11. The process of claim 10 wherein said process further comprises sparging said mixture or said solution with nitrogen prior to step c).

12. The process of claim 9 wherein said solution consists of said UHMW PE polymer and said spinning solvent.

13. The process of claim 9 wherein the solution includes UHMW PE in an amount of 4.0% or less by weight of the solution.

14. The process of claim 13 wherein said solution consists of said UHMW PE polymer and said spinning solvent.

15. The process of claim 9 wherein said UHMW PE polymer provided in a) has an intrinsic viscosity of at least about 35 dl/g as measured in decalin at 135° C. according to ASTM D1601-99.

16. The process of claim 13 wherein at least one of the solution filaments, the gel filaments and the solid filaments are stretched in one or more stages to form a yarn product having a tenacity of greater than 45 g/d, and wherein said UHMW PE polymer provided in a) has a ratio of weight average molecular weight to number average molecular weight ($M_w/M_n$) of 3 or less.

17. The process of claim 16 wherein said yarn product has an intrinsic viscosity of at least about 21 dl/g as measured in decalin at 135° C. according to ASTM D1601-99.

18. The process of claim 1 wherein the yarn intrinsic viscosity exceeds 95% relative to the intrinsic viscosity of the UHMW PE polymer.

* * * * *